United States Patent [19]

Schiffers

[11] Patent Number: 4,977,651

[45] Date of Patent: Dec. 18, 1990

[54] COVERING DEVICE FOR A FABRIC INLET AND OUTLET SLOT OF TENTER HOUSING

[75] Inventor: Theo Schiffers, Wurselen, Fed. Rep. of Germany

[73] Assignee: H. Krantz GmbH & Co., Wurselen, Fed. Rep. of Germany

[21] Appl. No.: 432,468

[22] Filed: Nov. 7, 1989

[30] Foreign Application Priority Data

Nov. 15, 1988 [DE] Fed. Rep. of Germany ..... 3838618

[51] Int. Cl.[5] ..... D06C 3/00; F26B 13/02

[52] U.S. Cl. ..... 26/106; 26/81; 26/92; 34/242

[58] Field of Search ..... 26/71, 81, 92, 106; 34/242

[56] References Cited

U.S. PATENT DOCUMENTS 2,348,174 5/1944 Blanchard et al. ..... 34/242

FOREIGN PATENT DOCUMENTS 1244699 7/1967 Fed. Rep. of Germany ..... 26/92
1460623 5/1969 Fed. Rep. of Germany .
3140935 5/1983 Fed. Rep. of Germany ..... 26/92

*Primary Examiner*—Werner H. Schroeder
*Assistant Examiner*—Bradley Kurtz DeSandro
*Attorney, Agent, or Firm*—Arthur B. Colvin

[57] ABSTRACT

A covering device for the inlet and outlet slots of a tenter comprises a flexible plastic strip whose ends are fastened in the region of the ends of the respective slot. In the area where the chain rail guides extend through the slot, the plastic strip is deflected in U-shaped configuration by deflector elements outside the slot and spanning the chain guides. The deflector elements are angularly oriented relative to the longitudinal axis of the slot at an angle of about 45 degrees and are fastened on a movable carriage connected to the chain guides so that movement of the chain guides transversely of the slot functions also to move the U-shaped configuration of the flexible plastic strip.

6 Claims, 1 Drawing Sheet

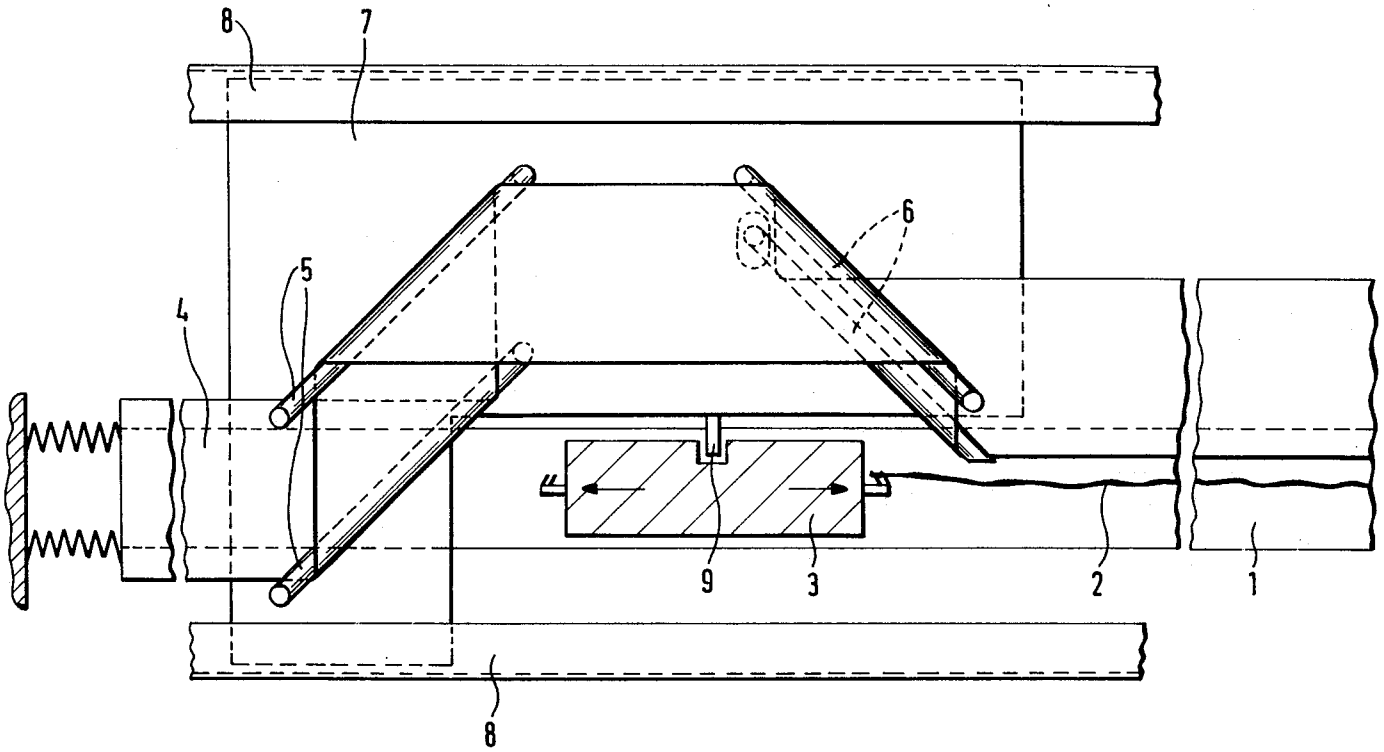
1
2
3
4
5
6
7
8
8
9

COVERING DEVICE FOR A FABRIC INLET AND OUTLET SLOT OF TENTER HOUSING

BACKGROUND AND FIELD OF INVENTION

This invention relates to a covering device for a fabric inlet and outlet slot of the housing of a tenter, through which the fabric is transported by two chains guided in rails. The rail chains pass with the fabric through the inlet and outlet slots., the free slot cross-section being essentially coverable by flexible strip material guided over deflection elements.

PRIOR ART

For free passage of the chains guided in rails, the fabric inlet and outlet slots of the housing of a tenter must have an appropriate height. Since furthermore the chains with their guide rails must be variably displaced widthwise relative to each other for the treatment of wide and narrow fabric webs, large openings necessarily result for the inlet and outlet slots. Cold air from the work room and hot treatment agent from the tenter can readily pass through these slots. The performance of a tenter is thereby greatly impaired. Moreover, access of air may have a very harmful effect on the fabric treatment. For example, where super heated steam is used as a treatment agent, non uniformity caused by cool air ingress reduces the quality of conversion treatment.

Covering devices for partly sealing fabric inlet and outlet slots are known in various designs. From U.S. Pat. No. 2,348,174 a covering device is known where the slot opening is closed to the extent possible by steel strips to be rolled up vertically or telescoping slides.

While steel strips to be rolled up vertically have proved very successful as closure between the guide rails of the chains and the slot ends, they are unsuitable as coverings of the slot openings between the two chains, because it is inevitable that especially the lower side of the fabric rubs against the sharp upper edge of the steel strip disposed below the fabric web, whereby a finish adhering to the fabric is scraped off at least areawise, which may lead to different treatment results in various portions of the fabric. Moreover, the fabric may be damaged by the sharp edge of the steel strips.

The telescoping slides proposed as an alternative do not have the above described disadvantage, as they are rounded on the side toward the fabric. Such telescoping slides, however, cannot be made in a manner reliable in operation in tenter frames which are designed for large differences in fabric width, because the slide plates may deflect and flex when being telescoped.

From DE-OS No. 14 60 623 a slot covering device is known wherein the slots between the chains guided in the rails are covered by endless strips, progressively increasing or decreasing in width. The strips are disposed above and below the fabric and guided around horizontally mounted guide rolls.

This known device is relatively costly, as it requires for the covering of each slot a total of four strips, namely, in addition to the strips disposed above and below the fabric web, two further strips, each of which must cover the slot area between the slot end and the chain or rail opposite the latter.

SUMMARY OF THE INVENTION

It is an object of invention to provide an improved covering device for tenter slots whereby much less strip material is needed for covering the slot. More particularly, in accordance with the invention no strip material need be stored, to be used only when the spacing of the chain guides mandates.

In brief, the problem is solved in accordance with the invention by forming a cover for each slot by a single strip of tensioned flexible polymeric material overlying the slot, the fabric being spaced from the slot in a U-shaped configuration encompassing the chain guides emerging from the slot. Deflector elements guide the fabric to define the U configuration and the deflectors are preferably connected for movement with the chain guide.

In this manner the seal or closure of the slots is automatically adjusted in accordance with the spacing of the chain guides which in turn are spaced apart in accordance with the fabric width.

By the use, according to the invention, of only one plastic strip in each instance it is possible simply to attach the two ends of the strip adjacent the slot ends. By the arrangement, according to the invention, of a total of four deflection elements per chain rail unit at the fabric inlet and outlet slot, the plastic strip can be passed around the respective chain rails unit in U form at a close distance, whereby, apart from the short arcuate stretches over which the plastic strip is deflected, all other straight stretches of the plastic strip are oriented so that its plane is aligned with the plane of the slot. Except for the U-shaped deflection portions of the plastic strip, the strip serves, independently of the position of the chain rail units, to cover the slot area between the respective chain rail units and the area located between said units and the respective slot ends with allowance for the U-shaped deflection stretches, the length of the plastic strip is thus substantially equivalent to the length of the respective fabric inlet and outlet slot.

According to an embodiment of the invention, the deflection elements consist of rods, of which the two provided on the side of each chain rail unit away from the fabric are farther apart than the two rods on the side of the chain rail unit toward the fabric.

Due to the different spacing of the rods, the strip is guided in the region of the slot end region situated outside the chain rail units centered on the slot and covers the latter over its full height, whereas the slot region between the chain rail units is covered by the strip only over a part of its height, so as not to hinder the free passage of the fabric web.

According to a further embodiment of the invention, the two rod pairs spanning a chain guide are mounted on a carriage, which carriage is connected to the respective chain rail unit and is movable longitudinally of the slot, the rods of each pair being mounted on the carriage at a mutually variable distance Due to the connection between the carriage and the respective chain rail unit, special control means for relocating the strip deflection in dependence on the respective position of the chain rail units are not needed, as the strip deflection is automatically shifted when the chain rail units are moved transversely.

Lastly a development of the invention further provides that the strip consists of a fabric coated with plastic of the polytetrafluoroethylene group.

A strip of such a plastic material, known for example under the trademark "TEFLON", has the special feature of good thermal stability, so that the covering device according to the invention is not subject to early wear even if the strip is exposed to high temperatures resulting from the treatment process inside the tenter housing.

BRIEF DESCRIPTION OF THE DRAWING

The drawing comprises a partly schematic fragmentary end elevational view of one end of a tenter device showing a portion of the covering strip, the deflector assembly covering the chain guide being shown in perspective.

DETAILED DESCRIPTION OF DRAWING

The drawing illustrates an example of realization of the invention over the area of a slot end (i.e. only half of the assembly needed to cover an entire slot) and of a chain rail unit for a fabric inlet or outlet slot, At each end of a slot 1, shown broken away, through which a fabric web 2 is passed in chain rail units or guides 3, a teflonized fabric strip 4 is fastened by its ends, the strip being under tension.

Strip 4 is passed around the chain rail unit 3 in U form over two pairs of deflection rods 5 and 6 in each instance. By relocation of the lower deflection rod 6, the lower edge of strip 4 can be brought closer to the top side of the fabric web 2.

The deflection rods 5 and 6 which are arranged at an angle (x) of about 45 degrees relative to the longitudinal direction of the slot 1 are fastened on a carriage 7 movable longitudinally of slot 1, which carriage can be shifted in longitudinal direction of the slot in guide rails 8 above and below slot 1. By a catch 9 the carriage 7 is coupled with the chain rail unit 3 so that the carriage follows every transverse movement of the chain rail unit 3. In this manner, the two U-shaped deflections of the strip 4 are always in registry with and encompass the two projecting chain guides 8 of each slot 1 when the chain guide devices are adjusted for different widths of fabric.

As will be apparent to those skilled in the art and familiarized with the instant disclosure, numerous variations in details of construction may be made in the illustrated embodiment without departing from the spirit of the invention which is thus to be broadly construed within the scope of the appended claims.

I claim:

1. A covering device for an entrance slot of a tenter device, said tenter device having variably spaceable chain guide rails extending through said entrance slot, said device comprising a tensioned flexible polymeric strip disposed in outward lapping relation of said slot, said strip having its opposed ends secured at the opposite ends of said slot, two pairs of deflector elements mounted on said tenter device in outwardly spaced relation to said slot, said deflector elements being oriented with their longitudinal axis at an angle of about 45 degrees relative to the longitudinal direction of said slot, said strip being arrayed about said deflector elements to define a U-shaped configuration encompassing the portions of said chain guide extending through said slot.

2. A covering device in accordance with claim 1 wherein said deflector elements comprise rods, two said rods being disposed at opposite sides of said chain guide in proximate spaced relation to said slot, each of the other two said rods being disposed in parallel spaced relation to a respective one of said first mentioned rods at a distance further from said slot.

3. A covering device in accordance with claim 1 wherein said rods are mounted on a carriage movable parallel to said slot, said carriage being operatively connected to said chain guide for movement along said slot in accordance with the adjusted position of said chain guide along said slot.

4. A covering device in accordance with claim 3 wherein the pair of rods at opposite sides of said chain guide are movable toward and away from each other.

5. A covering device in accordance with claim 1 wherein said flexible strip comprises a fabric coated with a plastic of the polytetrafluoroethylene group.

6. A covering device for an entrance or exit slot of a tenter, said tenter including a chain guide projecting through and transversely movable within said slot, comprising a tensioned flexible polymeric strip having its end portions secured adjacent the extremities of said slot, said strip outwardly lapping said slot, a deflector member operatively connected to said guide for movement with said guide longitudinally of said slot, said strip being arrayed over said deflector member and deformed by said deflector member into a generally U-shaped configuration encompassing the portions of said chain guide extending through said slot.

* * * * *